US005441341A

United States Patent [19]

Halsted

[11] Patent Number: 5,441,341

[45] Date of Patent: Aug. 15, 1995

[54] MORTAR MIXER WITH PLASTIC DRUM HAVING REINFORCED END WALLS

[75] Inventor: David W. Halsted, Hemlock, N.Y.

[73] Assignee: Stone Construction Equipment, Inc., Honeoye, N.Y.

[21] Appl. No.: 395,273

[22] Filed: Feb. 27, 1995

Related U.S. Application Data

[63] Continuation of Ser. No. 15,025, Feb. 5, 1993, abandoned.

[51] Int. Cl.[6] ..... B28C 5/14; B28C 7/16

[52] U.S. Cl. ..... 366/47; 366/185; 220/645

[58] Field of Search ..... 220/606, 645, 647; 366/45–47, 53, 62, 64, 66, 185, 189, 219

[56] References Cited

U.S. PATENT DOCUMENTS

| | | | |
|---|---|---|---|
| 1,293,506 | 2/1919 | Miller | 366/53 |
| 1,460,571 | 7/1923 | Carey | 366/46 |
| 1,505,263 | 8/1924 | Hewitt | 366/53 |
| 2,499,052 | 2/1950 | Brookins | 366/47 |
| 2,656,163 | 10/1953 | Schwarz | 220/606 |
| 2,987,302 | 6/1961 | Terry et al. | 366/47 |
| 3,294,271 | 12/1966 | Armbruster | 220/645 |
| 3,473,789 | 10/1969 | Dietrich . | |
| 3,761,058 | 9/1973 | Stone et al. . | |
| 3,905,519 | 9/1975 | Tertinek et al. | 222/166 |
| 3,931,748 | 1/1976 | Tertinek et al. | 74/606 |
| 3,932,006 | 1/1976 | Tertinek et al. . | |
| 3,963,258 | 6/1976 | Stone et al. | 280/47.34 |
| 4,043,540 | 8/1977 | Stone . | |
| 4,180,281 | 12/1979 | Tertinek | 280/457 |
| 4,211,491 | 7/1980 | Chaney et al. | 366/46 X |
| 4,435,082 | 3/1984 | Bishop | 366/47 |
| 4,491,415 | 1/1985 | Bishop | 366/47 |
| 4,521,116 | 6/1985 | Adsit | 366/54 |
| 4,569,648 | 2/1986 | Riederer et al. | 425/222 |
| 4,711,582 | 12/1987 | Kennedy | 366/279 |
| 4,750,840 | 6/1988 | Bishop | 366/54 |
| 4,756,623 | 7/1988 | Bishop | 366/57 |
| 4,761,076 | 8/1988 | Witcombe | 366/46 |
| 4,877,327 | 10/1989 | Whiteman, Jr. | 366/46 |
| 5,118,198 | 6/1992 | Whiteman, Jr. | 366/47 |

*Primary Examiner*—Charles E. Cooley

*Attorney, Agent, or Firm*—Jacobson, Price, Holman & Stern

[57] ABSTRACT

A mortar mixer having a generally cylindrical, horizontally disposed, pivotally supported mixer drum constructed of plastic material and more specifically to improvements in the form of metal end plates attached to and rigidifying the plastic end walls of the generally cylindrical drum. The metal end plates are associated with the end walls of the plastic drum in a unique manner to reinforce and support the end walls of the plastic drum in order to provide adequate support for maintaining the shape and configuration of the generally cylindrical plastic drum during the entire procedure of placing materials to be mixed in the drum, mixing the materials and dumping the mixed materials from the drum.

6 Claims, 2 Drawing Sheets

MORTAR MIXER WITH PLASTIC DRUM HAVING REINFORCED END WALLS

This is a continuation of application Ser. No. 08/015,025, filed Feb. 5, 1993 which was abandoned upon the filing hereof.

BACKGROUND OF THE INVENTION

1. FIELD OF THE INVENTION

The present invention generally relates to a mortar mixer having a generally cylindrical, horizontally disposed, pivotally supported mixer drum constructed of plastic material and more specifically to improvements in the form of metal end plates attached to and rigidifying the plastic end walls of the generally cylindrical drum. The metal end plates are associated with the end walls of the plastic drum in a unique manner to reinforce and support the end walls of the plastic drum in order to provide adequate support for maintaining the shape and configuration of the generally cylindrical plastic drum during the entire procedure of placing materials to be mixed in the drum, mixing the materials and dumping the mixed materials from the drum.

2. Description Of The Prior Art

Mixers of the type utilizing a horizontally disposed mixing drum of generally cylindrical configuration which is pivotally supported from a mobile frame and which includes a power driven mixing blade assembly oriented within the drum in sealed relation thereto with the upper portion of the drum having an opening through which material may be placed in the drum and through which the mixed material may be discharged when the drum is tilted about a horizontal axis are well known and have been manufactured for use as mortar mixers, plaster mixers and fire proofing mixers and the like for a number of years. The following U.S. patents disclose various features of this type of mixer.

U.S. Pat. Nos. 3,761,058, 3,932,006, 3,905,519, 3,963,258, 3,931,748, 4,043,540, 4,180,281

Recently, efforts have been made to construct the generally cylindrical mixer drum of plastic material such as high density cross linkable polyethylene or suitable equivalent plastic material rather than being constructed of relatively heavy steel which is subject to residual mortar sometimes being allowed to dry within the mixing drum which results in labor intensive removal procedures being required to break the mortar loose from the steel drum. The following U.S. patents relate to this field of endeavor.

U.S. Pat. Nos. 3,473,789, 4,521,116, 4,750,840, 4,761,076, 5,118,198, 4,877,327, 4,435,082, 4,491,415, 4,756,623, 4,569,648, 4,711,582

As indicated by the above mentioned patents and as discussed in several of the patents, mixing drums constructed of polyethylene are not sufficiently strong to support materials above certain densities and volumes due to the lack of ridigity of the plastic material from which the drum is constructed. The above prior patents disclose attempted solutions to this problem by the introductions of cradles or reinforcing frame members associated with the generally cylindrical polyethylene drums. However, the above prior patents do not disclose the concept of the cylindrical drum being constructed of polyethylene combined with rigid metal end plates connected with the end walls of the polyethylene drum with the metal end plates being associated with the end walls of the drum in a unique manner to rigidify the end walls and cylindrical drum in order that it can be used effectively with heavier or more dense materials and larger total weight of materials being mixed.

SUMMARY OF THE INVENTION

An object of the present invention is to improve a mortar mixer having a plastic drum of unitary polyethylene cross linkable material or other suitable plastic material in which the drum is horizontally disposed and pivotally supported by a mobile frame which also supports a power device such as a gasoline engine drivingly connected to a rotatable mixer paddle assembly disposed in the drum. The drum includes an opening disposed upwardly when material is placed in the drum and when material is being mixed within the drum with the drum then being pivoted to a dumping position for discharging material from the drum. The improvement is the provision of metal end plates secured against and to the outer surface of the end walls of the plastic cylindrical drum.

Another object of the invention is to provide a mortar mixer with plastic drum in accordances with the preceding object in which the metal end plates are received and secured in recesses formed in the outer surface of the end walls of the plastic drum with the end plates being secured to the end walls by fastening devices. The end plates each include an outwardly projecting central sleeve receiving bearing and seal assemblies and the end plates also include stop members to limit pivotal movement of the drum in one direction and to secure the drum with the opening in the upwardly oriented position with one of the end plates including a handle structure attached thereto for manual pivotal movement of the drum and a structure for pivoting the pivotal portion of the cover guard for the opening in the drum to an open position when the drum is tilted to discharge mixed material.

A further object of the invention is to provide a mortar mixer with plastic drum including metal end plates covering substantially the entire end walls of the plastic drum and secured within a recess formed in the outer surface of the end walls to enable effective rigidification and reinforcement of the end walls and plastic drum to enable a mortar mixer to be used with various materials of high density and high volumes and high total weight within the drum without the drum flexing or deforming during use.

These together with other objects and advantages which will become subsequently apparent reside in the details of construction and operation as more fully hereinafter described and claimed, reference being had to the accompanying drawings forming a part hereof, wherein like numeral refer to like parts throughout.

DESCRIPTION OF THE PREFERRED EMBODIMENT

Figure 1:
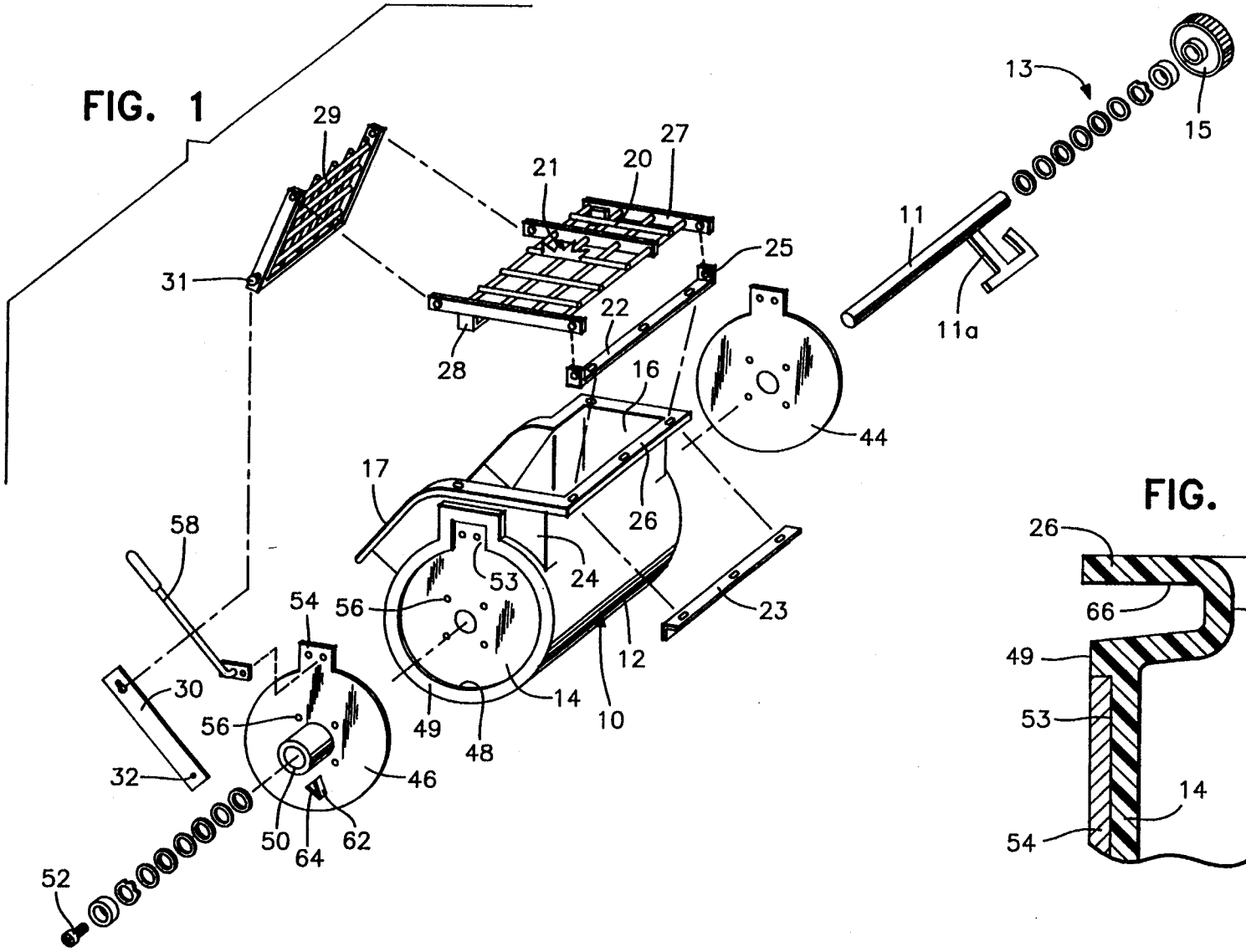
FIG. 1 exploded perspective view illustrating the components of the cylindrical drum and metal end plates spaced therefrom with other components of the drum also being spaced from the drum.

Referring now specifically to the drawings, the structure of the mortar mixer is conventional with respect to the supporting frame, power device and related structure with only the mixing drum being disclosed 10, driven paddle assembly including paddle shaft 11 and paddle 11*a* disclosed in previously cited U.S. Pat. No. 4,043,540. Other details of the mortar mixer are disclosed in the previously listed patents including the support structure 70 for the drum and the latch member 72 disclosed in previously cited U.S. Pat. No. 3,905,519. The drum 10 is constructed of cross linkable polyethylene or other suitable plastic material rather than being constructed of steel. The plastic drum 10 includes a peripheral, generally cylindrical wall 12 provided with end walls 14 of generally circular configuration which are of unitary construction with the peripheral wall 12. The portion of the drum 10 which normally faces upwardly is provided with an enlarged opening 16 which receives material being placed in the drum and enables mixed material to be poured from the drum when it is tilted or pivoted about a generally horizontal axis defined by a horizontal mixer paddle shaft 11 which includes mixer paddle 11*a*, spacers, bearings and seals 13 at each end thereof and an input gear 15 at one end thereof which is drivingly connected to a power source in a conventional manner. The opening 16 in the drum is defined by a laterally extending hollow wall 24 having a periphery defined by an outwardly extending flange 26. One side of the opening 16 is provided with a pouring spout 17 of reduced length which is defined by end walls 18 and a side wall 19 to enable the mixed material to be poured into a wheelbarrow or other container for transport to a point of use remote from the mixer. The opening 16 is provided with a stationary grid type guard 20 mounted rigidly on flange 26. The guard 20 includes an upwardly projecting bag opener 21 centrally located the thereon to facilitate opening of bags in a known manner. The guard 20 is secured to flange 26 by a bracket 22 extending along the top surface of flange 26 and a bracket 23 extending along the bottom of flange 26. The bracket 23 is of right angular cross-sectional configuration and the bracket 22 includes upstanding ends 25. Fastening bolts or the like secure the brackets 22 and 23 to flange 26 and secure the bracket ends 25 to side members 27 of guard 20. Additional side brackets 28 secure the side members 27 of guard 20 to flange 26 in spaced relation to brackets 22 and 23.

The pouring spout 17 is provided with a pivotal grid-type guard 29 pivotally attached to side members 27 of guard 20 with the other end of guard 29 being swingable between open and closed positions by an actuator link or bar 30 connected to guard 29 at point 31 and to the drum at point 32.

Figure 5:
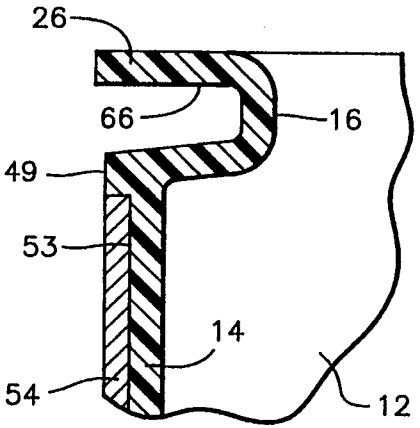
FIG. 5 is a fragmental sectional view, on an enlarged scale, illustrating the structure of the end wall of the drum and a metal end plate.
Figure 2:
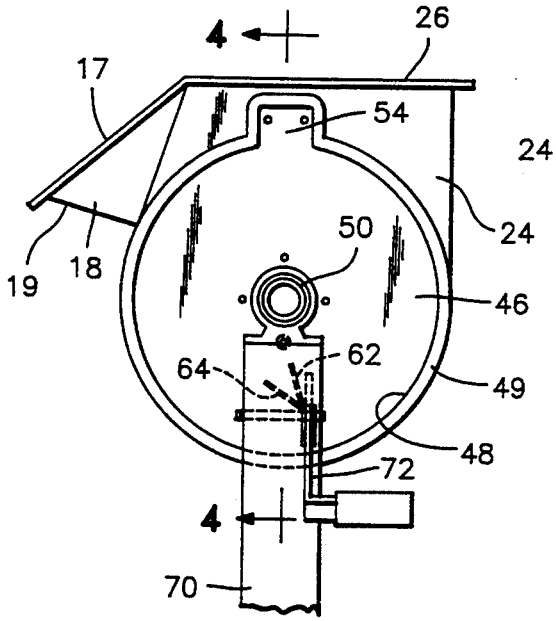
FIG. 2 is an end elevational view illustrating one end of the drum with end plate mounted thereon.
Figure 3:
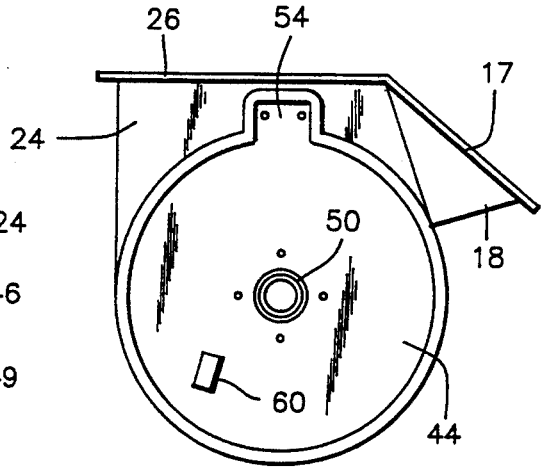
FIG. 3 is an end view of the opposite end of the drum with the end plate mounted thereon.
Figure 4:
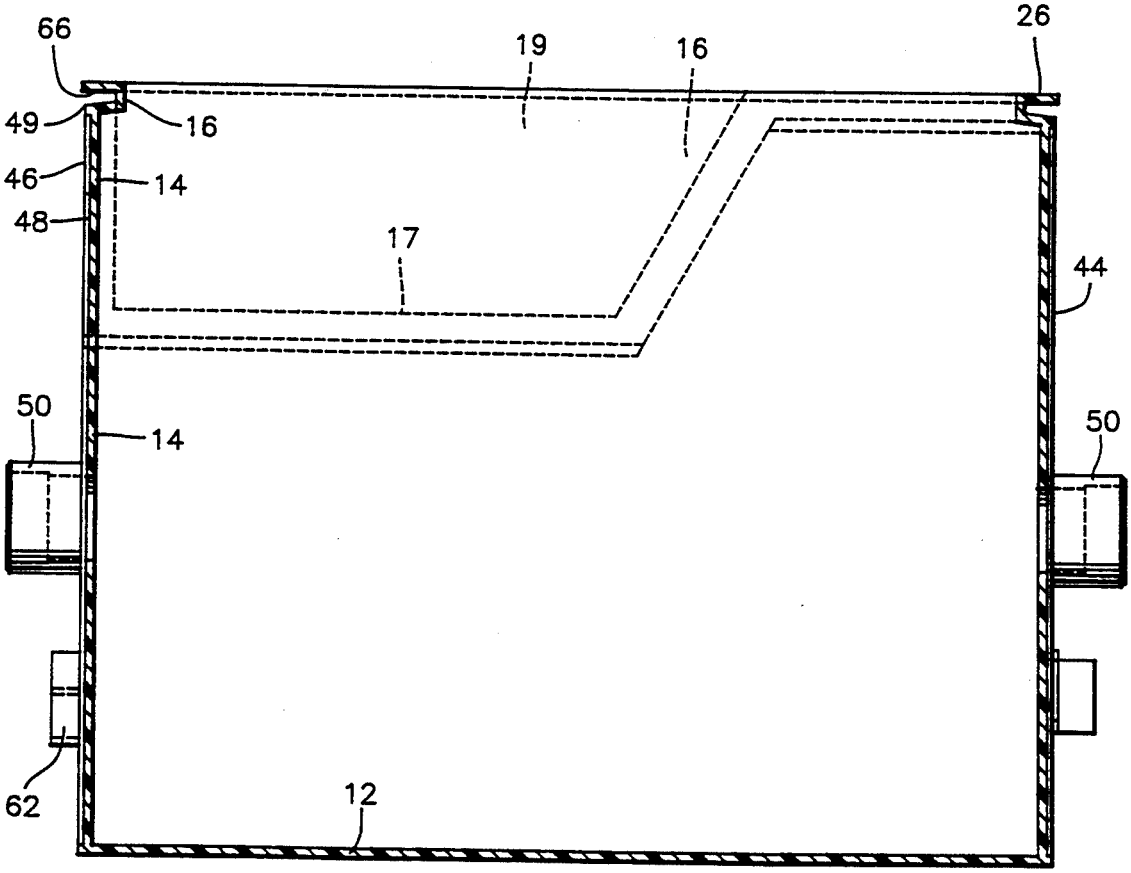
FIG. 4 is a longitudinal sectional view of the drum illustrating the construction of the drum and end plates.

The improvement made in the drum 10 is the provision of a pair of metal end plates 44 and 46 of generally circular configuration which are closely received in circular recesses 48 formed in the outer surface of each of the end walls 14 by flanges 49 as illustrated in FIGS. 1, 4 and 5. The end plates 44 and 46 are each provided with a centrally disposed cylindrical axial sleeve or projection 50 which receives the bearing and seal assemblies 13 and a threaded retainer 52 is provided for engaging the outer end of the shaft 11 for retaining these components assembled within the sleeve or projection 50. As illustrated the recess 48 in, each end wall 14 includes a radial extension 53 and each of the metal end plates 44 and 46 have a radial interengaging projection 54 received in the recess extension 53 and apertures 56 receiving suitable fasteners secure the end plates 44 and 46 in position and also secure a handle 58 to the projection 54by using suitable fasteners. The end plate 44 includes a stop member 60 welded thereto and the end plate 46 includes a keeper stop member 62 with a cam plate 64 thereon for association with a pivotal latch 72 to retain the drum in its position for mixing and enabling the drum to pivot to dumping position when the pivotal latch 72 is released from the keeper stop member 62.

As illustrated in FIGS. 4 and 5, the flange 26 includes a groove 66 which opens outwardly of the wall 14 thus defining a generally channel shaped flange which opens axially and which rigidifies the periphery of the end walls 14 and also helps to rigidify the peripheral wall 12. The metal end plates 44 and 46 are closely received in the recesses 48 and secured to the outer surface of the end walls 14 with fasteners at the center of the end plate just outwardly of the cylindrical projection or sleeve 50 and through the radially projecting portion 54 thereby rigidly securing the end plates to the end walls for rigidifying the end walls and the cylindrical drum 10 with the periphery of the end plates 44 and 46 being closely received within the recess 48 to further rigidify the end walls and the generally cylindrical peripheral wall of the drum.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents ay be resorted to, falling within the scope of the invention.

I claim:

1. A mixer drum comprising a generally cylindrical member having a peripheral wall and end walls adapted to be supported generally horizontally and adapted to receive a driven paddle assembly to mix material therein, said peripheral wall including an upwardly extending opening to receive material to be mixed and to discharge mixed material when the drum is pivoted about a longitudinal drum axis to move the opening from an upwardly extending position to a downwardly inclined position, said cylindrical member and said end Walls being constructed of plastic material, the improvement comprising each end wall of said drum including a recess in the outer surface thereof defined by an axially projecting flange around the periphery of the end wall, metal end plates attached to and substantially covering the entire outer surface of the end walls, each recess receiving one of said end plates with the periphery of each end plate engaging the periphery of the recess to reinforce and rigidify the end walls, each end plate including a centrally disposed axially outwardly extending cylindrical sleeve adapted to receive and support a mixer paddle assembly shaft and bearing and seal assembly, and adapted to support and retain the shaft in the sleeve, said sleeves also adapted to support the drum from support structure to enable tilting pivotal movement of the drum about the longitudinal axis.

2. A mixer drum comprising a generally cylindrical member having a peripheral wall and end walls adapted to be supported generally horizontally and adapted to receive a driven paddle assembly to mix material therein, said peripheral wall including an upwardly extending opening to receive material to be mixed and to discharge mixed material when the drum is pivoted about a longitudinal drum axis to move the opening from an upwardly extending position to a downwardly inclined position, said cylindrical member and said end walls being constructed of plastic material, the improvement comprising each end wall of said drum including a recess in the outer surface thereof defined by an axially projecting flange around the periphery of the end wall, metal end plates attached to and substantially covering the entire outer surface of the end walls, each recess receiving one of said end plates with the periphery of each end plate engaging the periphery of the recess to reinforce and rigidify the end walls, said recess in at least one of said end walls including a radial extension aligned with the opening in the cylindrical member, at least one of said end plates including a correspondingly shaped radial projection received in the radial extension, the radial projection on said one of said end plates adapted to receive a handle thereon to enable the drum to be pivoted to the position for discharging material therefrom.

3. A mixer drum comprising a generally cylindrical member having a peripheral wall and end walls adapted to be supported generally horizontally and adapted to receive a driven paddle assembly to mix material therein, said peripheral wall including an upwardly extending opening to receive material to be mixed and to discharge mixed material when the drum is pivoted about longitudinal drum axis to move the opening from an upwardly extending position to a downwardly inclined position, said cylindrical member and said end walls being constructed of plastic material, the improvement comprising each end wall of said drum including a recess in the outer surface thereof defined by an axially projecting flange around the periphery of the end wall, metal end plates attached to and substantially covering the entire outer surface of the end walls, each recess receiving one of said end plates with the periphery of each end plate engaging the periphery of the recess to reinforce and rigidify the end walls, one of said end plates including a stop member rigidly affixed thereto adapted to cooperate with a latch member mounted on a support structure to retain the drum with the opening extended upwardly for receiving and mixing material and enabling release of the drum for pivotal movement about the longitudinal axis to a material dumping position.

4. A mixer drum comprising a generally cylindrical member having a peripheral wall and end walls adapted to be supported generally horizontally and adapted to receive a driven paddle assembly to mix material therein, said peripheral wall including an upwardly extending opening to receive material to be mixed and to discharge mixed material when the drum is pivoted about a longitudinal drum axis to move the opening from an upwardly extending position,to a downwardly inclined position, said cylindrical member and said end walls being constructed of plastic material, the improvement comprising each end wall of said drum including a recess in the outer surface thereof defined by an axially projecting flange around the periphery of the end wall, metal end plates attached to and substantially covering the entire outer surface of the end walls, each recess receiving one of said end plates with the periphery of each end plate engaging the periphery of the recess to reinforce and rigidify the end walls, said opening including a pouring spout in an edge portion thereof, a stationary guard fixed in overlying relation to said opening, a pivotal guard mounted in overlying relation to the pouring spout, and means interconnecting the pivotal guard and drum to pivot the pivotal guard in response to pivotal movement of said drum about the longitudinal axis.

5. A mortar mixer comprising a generally horizontally disposed drum having a generally cylindrical peripheral wall and generally circular end walls supported for pivoting about a longitudinal drum axis, said drum being constructed of plastic material subject to deformation upon introduction of and mixing of materials in the drum, and an end plate engaged with and covering substantially the entire outer surface of each end wall, each end wall including a recess in the outer surface there, said recess being defined by a peripheral, axially extending flange of unitary construction with the end wall, one of said end plates being closely received in each of said recesses, each of said end plates being generally circular and constructed of rigid metal to reinforce said plastic end walls to enable the introduction of and mixing of materials in the drum without deformation of the plastic end walls, said recess in at least one of said end walls including a radial extension, at least one of said metal end plates including a radial projection closely received in the radial extension adapted to receive a handle thereon to enable the drum to be pivoted to a position for discharging material therefrom.

6. A mortar mixer comprising a generally horizontally disposed drum having a generally cylindrical peripheral wall and generally circular end walls supported for pivoting about a longitudinal drum axis, said drum being constructed of plastic material subject to deformation upon introduction of and mixing of materials in the drum, and an end plate engaged with and covering substantially the entire outer surface of each end wall, each end wall including a recess in the outer surface thereof, said recess being defined by a peripheral, axially extending flange of unitary construction with the end wall, one of said end plates being closely received in each of said recesses, each of said end plates being generally circular and constructed of rigid metal to reinforce said plastic end walls to enable the introduction of and mixing of materials in the drum without deformation of the plastic end walls, each of said metal end plates including a centrally disposed, axially extending sleeve on the outer surface thereof for rotatably supporting a mixer paddle shaft extending outwardly through each plastic end wall of the drum.

* * * * *